US010827841B1

(12) United States Patent
Tsai

(10) Patent No.: US 10,827,841 B1
(45) Date of Patent: Nov. 10, 2020

(54) CHAIR WAIST BACKREST HEIGHT ADJUSTING DEVICE

(71) Applicants: ZHONGSHAN SHI SONGLIN FURNITURE CO., LTD, Zhongshan (CN); Chi-Min Tsai, Chai-Yi Hsien (TW)

(72) Inventor: Hsuan-Chin Tsai, Chai-Yi Hsien (TW)

(73) Assignee: ZHONGSHAN SHI SONGLIN FURNITURE CO., LTD, Zhongshan (CN)

( * ) Notice: Subject to any disclaimer, the term of this patent is extended or adjusted under 35 U.S.C. 154(b) by 0 days.

(21) Appl. No.: 16/580,009

(22) Filed: Sep. 24, 2019

(51) Int. Cl.
*A47C 7/46* (2006.01)
*A47C 7/40* (2006.01)

(52) U.S. Cl.
CPC ..... *A47C 7/462* (2013.01); *A47C 7/402* (2013.01); *A47C 7/405* (2013.01)

(58) Field of Classification Search
CPC ..... A47C 7/405; A47C 7/402; A47C 7/462
USPC ..... 297/284.7
See application file for complete search history.

(56) References Cited

U.S. PATENT DOCUMENTS 2,756,809 A * 7/1956 Endresen ..... B60N 2/7029 297/284.7
3,059,971 A * 10/1962 Becker ..... A47C 7/405 297/353
6,354,662 B1 * 3/2002 Su ..... A47C 7/46 297/284.4
8,690,249 B2 * 4/2014 Kang ..... A47C 7/402 297/353
10,602,847 B2 * 3/2020 Zouzal ..... B60N 2/66
2011/0095588 A1 * 4/2011 Jen ..... A47C 1/023 297/354.12

FOREIGN PATENT DOCUMENTS

CN 2612288 Y 4/2004
DE 4228637 A1 * 3/1994 ..... A47C 7/467
DE 19925306 A1 * 12/2000 ..... A47C 7/405

* cited by examiner

*Primary Examiner* — Milton Nelson, Jr.
(74) *Attorney, Agent, or Firm* — Alan D. Kamrath; Karin L. Williams; Mayer & Williams PC

(57) ABSTRACT

A chair waist backrest height adjusting device includes a chair backrest bracket above the backrest, a worm rotated by turning the adjusting rod to slightly lower position, a first gear that is engaged with it and a second gear that is coaxially rotated with the first gear, and the chair backrest bracket under the backrest is provided with a waist backrest that can be slid up and down. The back of the waist backrest is provided with a tooth-row that is engaged with the second gear, so that the seated person on the chair can stretch out one or two hands to the adjustment rod for the forward or reverse turning operation, and the waist backrest can easily drive the waist backrest up and down, further the waist backrest is more easily adjusted, and there will be no displacement in the adjusted waist backrest.

1 Claim, 6 Drawing Sheets

CHAIR WAIST BACKREST HEIGHT ADJUSTING DEVICE

BACKGROUND OF INVENTION

1. Field of the Invention

The present invention relates generally to a waist backrest on a chair backrest that can support the waist of the seated person and can be slid up and down along a chair backrest bracket. The chair backrest bracket is provided with first gear that is engaged with a worm and parallel with a second gear. The worm is further provided with an adjusting rod for the user to rotate, and also the waist backrest is provided with a tooth-row that is engaged with the second gear, so that the adjusting rod is rotated to drive the worm, the first gear and second gear, and then drive the tooth-row, so that the waist backrest can be adjusted up and down.

2. Description of Related Art

The chair backrest of a general office chair is used for the back lean of the seated person, which aims to reduce the strength required for the seated person to straighten the back, enabling a longer seating and comfortable support. The chair backrest is provided with the backrest for the seated person to lean upon, and also a waist backrest is additionally provided under the backrest to provide support for the seated person's waist, increasing the overall comfort during seating.

However, the waist backrest on the chair backrest usually adopts the fixed design, that is, it is at a fixed height and cannot be adjusted in height, resulting in a design in which seated persons of different body heights cannot be fully supported by the waist backrest, causing the waist backrest to fail to achieve real results.

The CN2612288Y patent suggests a waist backrest that can be adjusted up and down in the height, where two sides of the waist backrest body is provided with an embedded hook, and two sides of the chair backrest skeleton at the corresponding position is provided with a long adjusting slot for that the embedded hook can be hooked in, so that the embedded hook can be slid up and down in the long adjusting slot. Since the body of the waist backrest is withstood by the tight chair backrest net body, when the backrest is not adjusted without force, the waist backrest will not be displaced; on the contrary, the waist backrest is pulled by the upper and lower force, the waist backrest can be slid to the position where the seated person leans against the waist.

Thus, to overcome the aforementioned problems of the prior art, it would be an advancement in the art to provide an improved structure that can significantly improve the efficacy.

Therefore, the inventor has provided the present invention of practicability after deliberate design and evaluation based on years of experience in the production, development and design of related products.

SUMMARY OF THE INVENTION

Therewith, in order to improve the trouble and difficulty of the aforementioned known waist backrest adjustment as well as the problem that the chair backrest may be slid down due to slack of the chair backrest net body, the present invention provides a chair backrest bracket provided with a worm and gear that can be driven by an adjustable rod. The gear is engaged with the tooth-row disposed behind the waist backrest on the chair backrest bracket, so that the seated person can easily drive the waist backrest up and down by turning the adjusting rod with one hand or both hands, and after the waist backrest is adjusted to the appropriate height, there will be no problem of sliding displacement.

The technical solution adopted by the present invention to solve its technical problems is: a backrest is arranged above a chair backrest bracket, and a waist backrest that can be sliding up and down is arranged on the chair backrest bracket under the backrest, a longitudinal tooth-row is arranged on the back of the waist backrest, and a second gear that is engaged with the tooth-row on chair backrest bracket at the corresponding position is arranged. The second gear is coaxially disposed with a first gear that is rotated synchronously. The chair backrest bracket is recessed with a holding slot of a supporting shaft therein, so that the first gear shaft and second gear shaft are fixed on the supporting shaft. The chair backrest bracket is provided with an adjusting rod cross the holding slot, and the adjusting rod is fixed with the worm engaged with the first gear, so that the rotated adjusting rod drive the waist backrest that can be adjusted up and down through the first, second gear and the tooth-row.

Therefore, through said waist backrest on the chair backrest of the present invention for supporting the seated person's waist, the height of the waist backrest can be easily adjusted by the adjusting rod, where not only the waist backrest of the chair backrest on the same chair can be adjusted to be fit for lean of the seated person at different heights, but also the adjustment operation is easier, and there will be no sliding displacement in the adjusted waist backrest.

BRIEF DESCRIPTION OF THE DRAWINGS

The present invention will be further described below in conjunction with the accompanying drawings and embodiments.

DETAILED DESCRIPTION OF THE INVENTION

Figure 1:
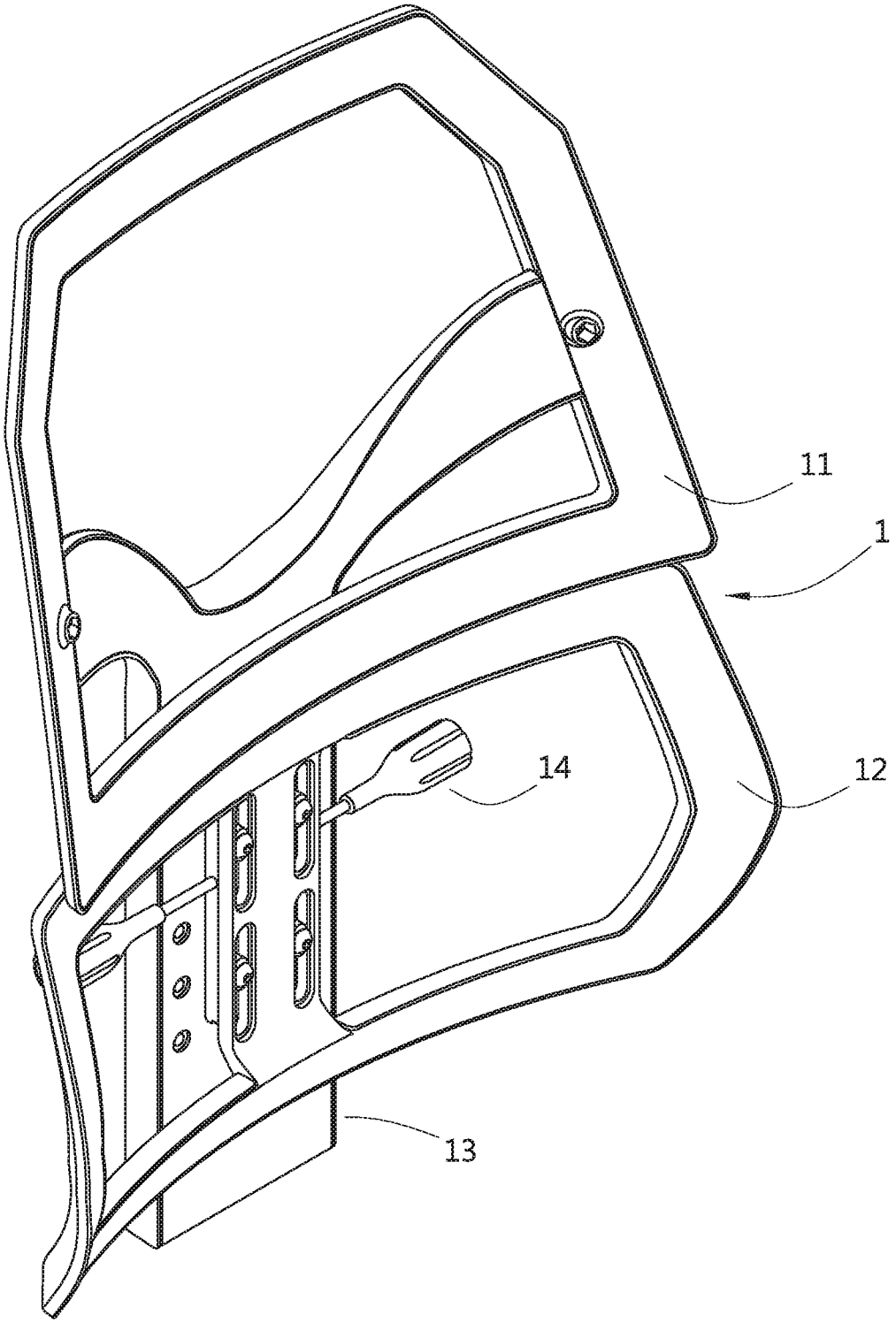
FIG. 1 is a three-dimensional schematic diagram of the chair backrest of the present invention.

Referring to FIG. 1, the chair backrest 1 includes a backrest 11 disposed above the chair backrest bracket 13 and a waist backrest 12 that can be slid up and down on the chair backrest bracket 13 under the backrest 11, and also the chair backrest bracket 13 is provided with an adjustment rod 14 that can adjust up and down the waist backrest 12 at the corresponding position.

Figure 2:
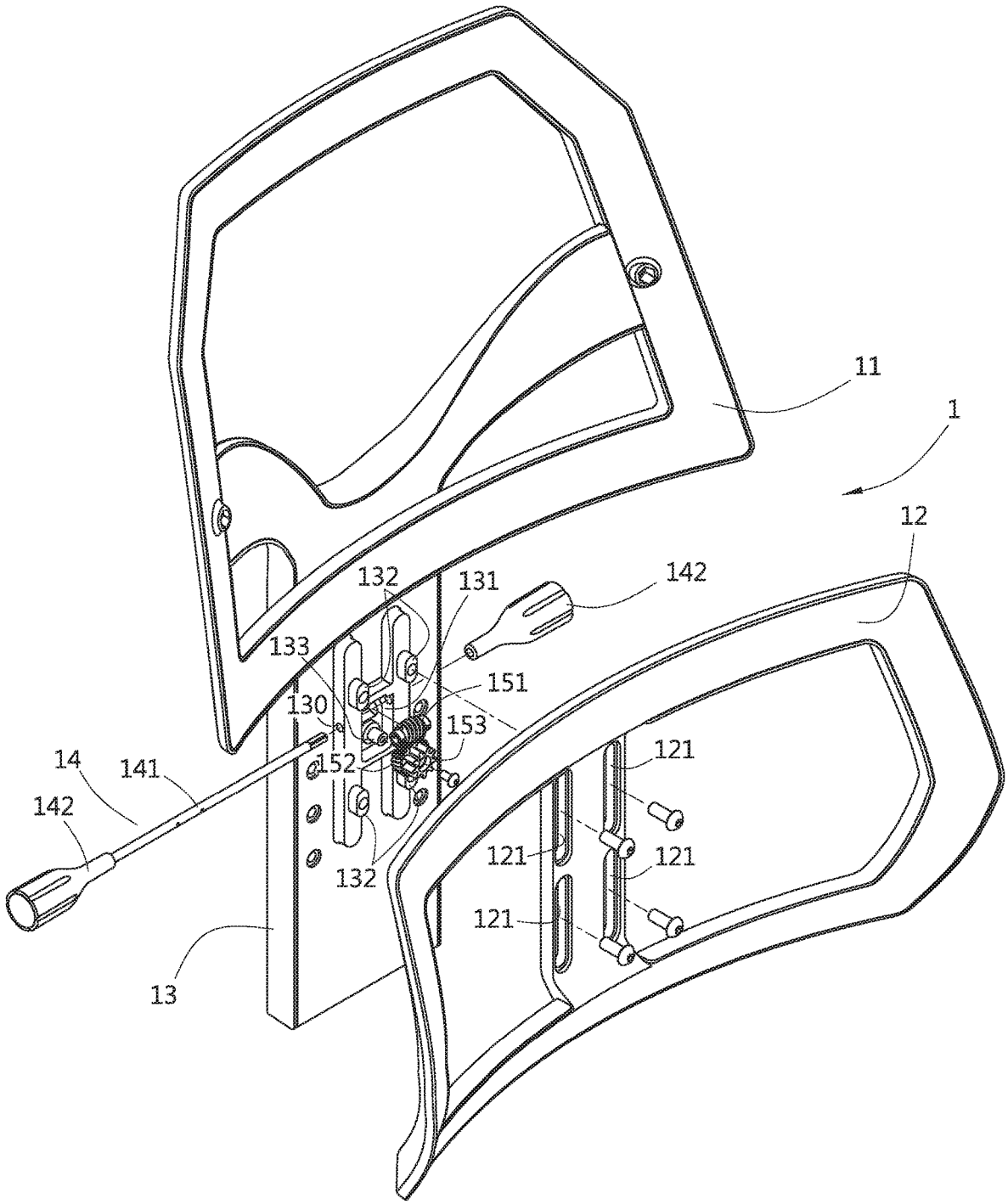
FIG. 2 is a three-dimensional decomposition schematic diagram of the chair backrest of the present invention.
Figure 3:
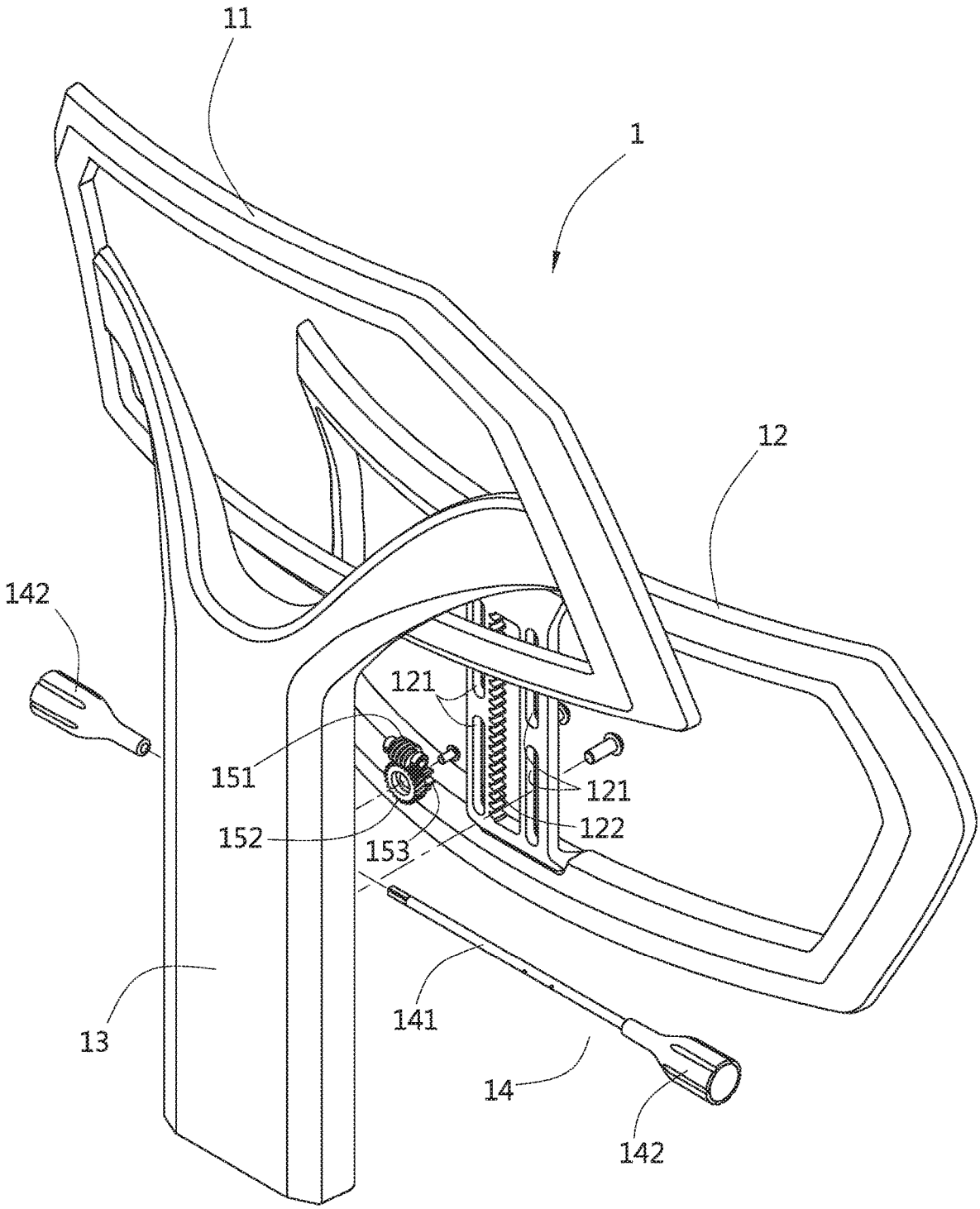
FIG. 3 is a three-dimensional decomposition schematic diagram of the chair backrest of the present invention at another direction.
Figure 4:
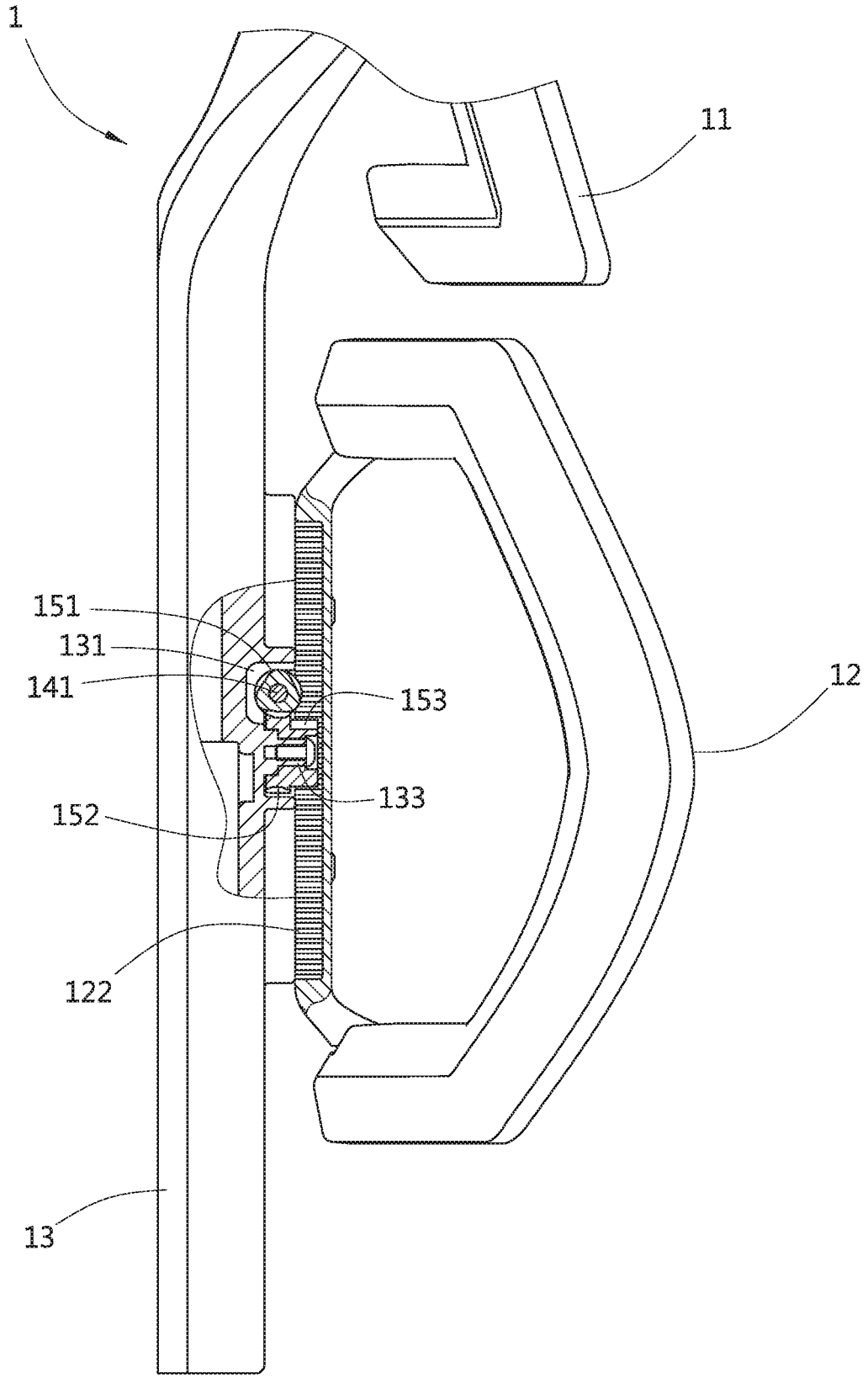
FIG. 4 is a side sectional schematic diagram of the chair backrest of the present invention.

The up and down adjustment structure of the above waist backrest 12 is as shown in FIGS. 2 to 4, and a holding slot 131 is disposed on the chair backrest bracket 13 corresponding to the waist backrest 12, and a supporting shaft 133 is further disposed in the slot 131. A through shaft hole 130 is disposed at the side corresponding to the holding slot 131 on the chair backrest bracket 13, and a worm 151 is disposed in the holding slot 131. The adjustment rod 14 includes a rotatable rod 141 where through the shaft hole 130 is crossly inserted into the holding slot 131 and fixed with the worm 151, and the two ends of the rotating rod 141 are extended and respectively provided with a rotary handle 142 that is easily operated, so that the rotating rod 141 can drive the worm 151 by rotating the rotary handle 142 at either end or both ends, and then a first gear 152 and a second gear 153 are coaxially paralleled and rotated synchronously, so that the first gear 152 and second gear 153 are disposed on the supporting shaft 133 in the holding slot 131, and the worm 151 is engaged with the first gear 152.

Further, the upper and lower sides of the chair backrest bracket 13 corresponding to the waist backrest 12 are respectively provided with convex guiding part 132, and the waist backrest 12 corresponding to the convex guiding part 132 is provided with a guiding groove 121 for sliding, and then the waist backrest 12 is locked by the screw at the convex guiding part 132, so that the waist backrest 12 can be slid up and down by the convex guiding part 132 and the guiding slot 121.

Further, at the back of the waist backrest 12 corresponding to the second gear 153 at the chair backrest bracket 13, a longitudinally disposed tooth-row 122 is engaged, so that the waist backrest 12 can be slid up and down by the tooth-row 122 through forward and reverse rotation of the second gear 153.

Figure 5:
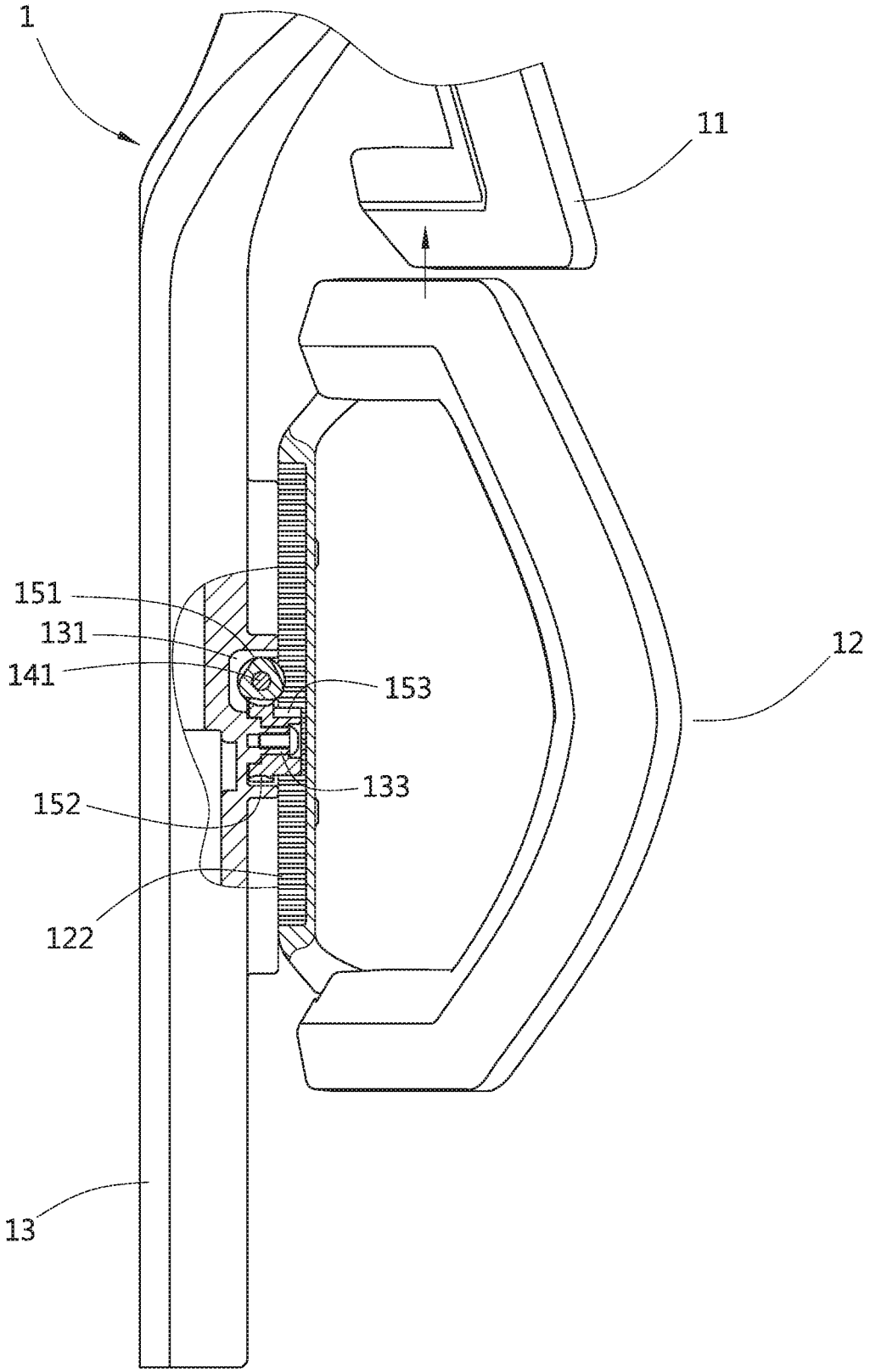
FIG. 5 is a schematic diagram of the adjusted-up chair backrest waist backrest of the present invention.
Figure 6:
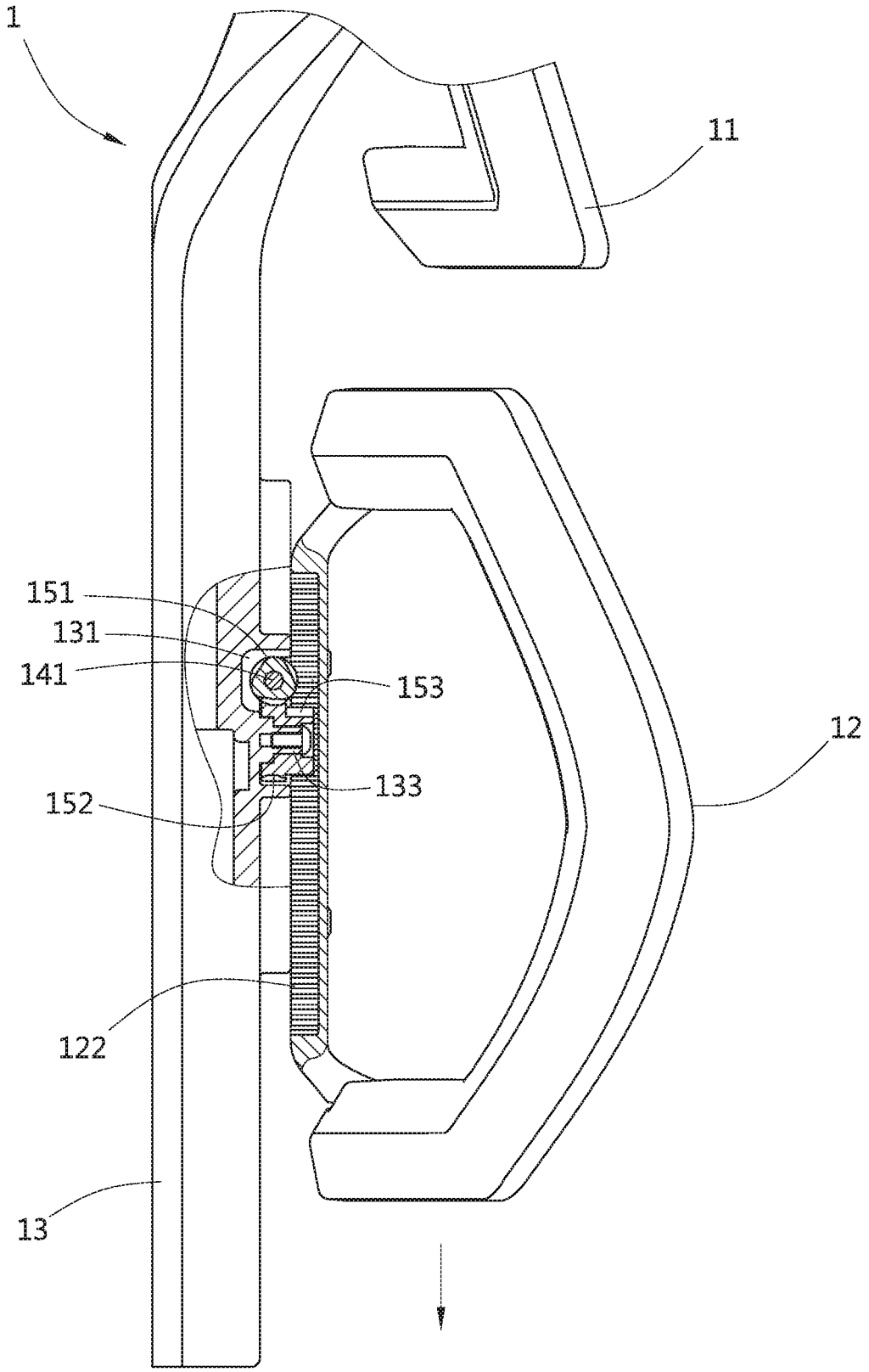
FIG. 6 is a schematic diagram of the adjusted-down chair backrest waist backrest of the present invention.

Referring to FIG. 5 and FIG. 6, when the seated person is seated on the chair and stretches out one hand or two hands to the back of the waist backrest 12, the rotary handle 142 of the adjusting rod 14 can be easily turned in the forward or reverse direction. After the worm 151 is rotated in the forward or reverse direction by the rotating rod 141, the first gear 152 through the second gear 153 engaged with the tooth-row 122 can drive the waist backrest 12 to move up or down to the position where the waist is leaning against and stop, that is, the adjustment procedure is completed. Therefore, through said operation method, the seated person can easily adjust the upper and lower positions of the waist backrest 12 with one hand or both hands, and there is no skewing during adjustment, and the adjusted waist backrest 12 will not be moved again, so as to ensure the correct position.

The invention claimed is:

1. A chair waist backrest height adjusting device comprising:

a chair backrest bracket, a waist backrest, and a backrest disposed above the chair backrest bracket, wherein the waist backrest is configured to be slid up and down the chair backrest bracket, wherein a longitudinal tooth-row is disposed on the back of the waist backrest;

wherein the chair backrest bracket has a first gear and a second gear, wherein the second gear is engaged with the longitudinal tooth-row disposed on the back of the waist backrest, and the first gear is coaxially disposed with the second gear and rotated synchronously;

wherein a holding slot with a supporting shaft is recessed on the chair backrest bracket, so that the first gear shaft and second gear shaft are fixed on the supporting shaft;

wherein the chair backrest bracket has an adjusting rod inserted into the holding slot, and wherein the adjusting rod is fixed with a worm engaged with the first gear in the holding slot, such that rotation of the adjusting rod causes the waist backrest to be adjusted up and down by the first gear, the second gear and the tooth-row.

* * * * *